United States Patent [19]

Walker et al.

[11] Patent Number: 4,619,554

[45] Date of Patent: Oct. 28, 1986

[54] GUTTER OUTLET TUBE

[76] Inventors: Landis C. Walker, 72 Crystal River Dr., Riverdale, Ga. 30274; Marcus J. Bailey, 1217 Lanier Blvd., Atlanta, Ga. 30306

[21] Appl. No.: 641,183

[22] Filed: Aug. 15, 1984

[51] Int. Cl.[4] ..... E04D 13/08

[52] U.S. Cl. ..... 405/120; 52/16; 285/194

[58] Field of Search ..... 52/11–16; 405/118–121, 127; 138/108; 285/189, 194, 238

[56] References Cited

U.S. PATENT DOCUMENTS

| | | | |
|---|---|---|---|
| 2,274,078 | 2/1942 | Marzolf | 405/120 |
| 2,832,202 | 4/1958 | Norum | 405/120 |
| 3,053,564 | 9/1962 | Evans | 285/189 |
| 3,616,582 | 11/1971 | Waler | 52/16 |
| 3,638,369 | 2/1972 | Albrecht | 52/16 |
| 3,703,194 | 11/1972 | Giordano | 52/16 |
| 4,328,694 | 5/1982 | Beaumont | 405/120 |
| 4,368,601 | 1/1983 | Price | 52/12 |

FOREIGN PATENT DOCUMENTS

| | | | |
|---|---|---|---|
| 2529992 | 1/1984 | France | 285/189 |
| 1269351 | 4/1972 | United Kingdom | 285/189 |

*Primary Examiner*—John E. Murtagh

*Attorney, Agent, or Firm*—Newton, Hopkins & Ormsby

[57] ABSTRACT

A one-piece outlet tube for joining the flat bottom wall of a metal gutter with a vertical downspout is formed from an initially flat blank. A continuous flat support flange extends around the margin of the gutter outlet tube at its upper end and rests upon the gutter flat bottom wall adjacent to an opening provided in this wall to receive the outlet tube. Integral outwardly struck downwardly tapering lock lugs are formed on the four side walls of the outlet tube closely beneath the flat flange for secure locking engagement beneath the gutter flat bottom wall when the outlet tube is inserted downwardly through the opening of this wall. The outlet tube is sealed with the gutter flat bottom wall around its support flange.

5 Claims, 6 Drawing Figures

GUTTER OUTLET TUBE

BACKGROUND OF THE INVENTION

The present invention relates to a gutter outlet tube, and the broad objective of the invention is to provide the simplest possible, most convenient and the most secure arrangement for joining the bottom wall of a rain gutter with a downspout by means of an outlet tube.

More specifically, the objective of the invention is to provide a gutter outlet tube of one piece construction which may be formed from a simple flat metal blank into a substantially rectangular tapered body having an interlocked seam on one side wall and a flat outwardly projecting marginal flange around its top end, closely beneath which integral outstruck downwardly tapered lock lugs are formed on the four side walls of the outlet tube.

Various gutter/downspout connections are known in the prior art, and the present invention is an improvement and substantial simplification of the known prior art, rendering the invention less expensive to manufacture, easier and more convenient to install, and capable of forming a more secure and trouble-free joint between a gutter and downspout.

U.S. Pat. No. 2,274,078, Marzolf, discloses a downspout connection for a thick wooden gutter having a curved bottom. Because of the thickness and curvature of the gutter, the Marzolf connection requires the use of an outlet tube having a complex curved top flange and a separately formed, separately installed lower collar which must be slid upwardly on the outlet tube against the curved bottom of the gutter and into interlocking relationship with lugs formed on two opposite sides of the outlet tube. The Marzolf construction is complex, costly and more difficult to install than the present invention and lacks the one-piece construction of the invention. There is a greater chance for a loose or poor fit for the outlet tube according to Marzolf in comparison to the present invention.

U.S. Pat. No. 3,616,582, Walek et al., discloses a gutter outlet tube having a flat upper support flange to rest on the floor of a rain gutter. Considerably below its flange, the outlet tube has separately formed spring clips attached to one pair of its side walls which yieldingly snap into aligned apertures of the adjacent downspout. The construction is expensive in that the downspout must be apertured with precision and the separately fabricated spring clips must be attached to the outlet tube by welding or the like with precision. Because of these requirements the resulting joint formed between the gutter and downspout is less secure and more subject to misalignment than the present invention. The present invention constitutes a substantial improvement on all of the known prior art particularly the above-named patents.

Other features and advantages of the invention will become apparent during the course of the following detailed description.

DETAILED DESCRIPTION

Figure 6:
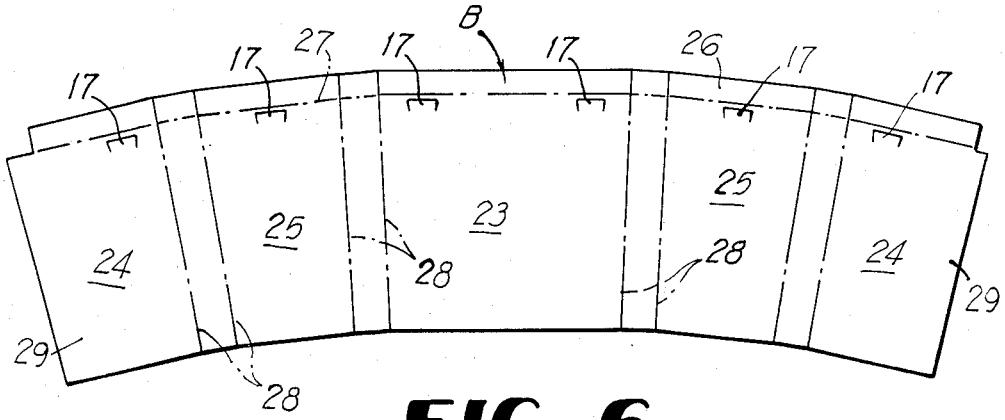
FIG. 6 is a plan view of a blank utilized to make the one-piece gutter outlet tube according to the invention.

Referring to the drawings in detail wherein like numerals designate like parts, a one-piece gutter outlet tube 10 according to the essence of the invention is constructed from an initially flat metal blank B shown in FIG. 6. The gutter outlet tube is generally rectangular in cross section and somewhat tapered toward its lower end. It includes major side walls 11 and minor side walls 12 joined to the major side walls by corner relatively narrow diagonal portions or webs 13.

One of the major side walls 11 contains a continuous mechanical lock seam 14 preferably secured by mechanical crimping as at 15.

A relatively narrow flat marginal support flange 16 is formed continuously around the margin of the rectangular outlet tube at its upper end, the flange 16 projecting outwardly of the body portion of the outlet tube.

Closely beneath the flange 16 on the four side walls 11 and 12 of the outlet tube are provided integral outwardly struck downwardly tapering lock lugs 17 whose tops are spaced from the flange 16 by a distance only slightly greater than the thickness of the flat bottom wall 18 of the rain gutter 19 with which the outlet tube 10 is employed to join the gutter to a downspout 20.

Figure 1:
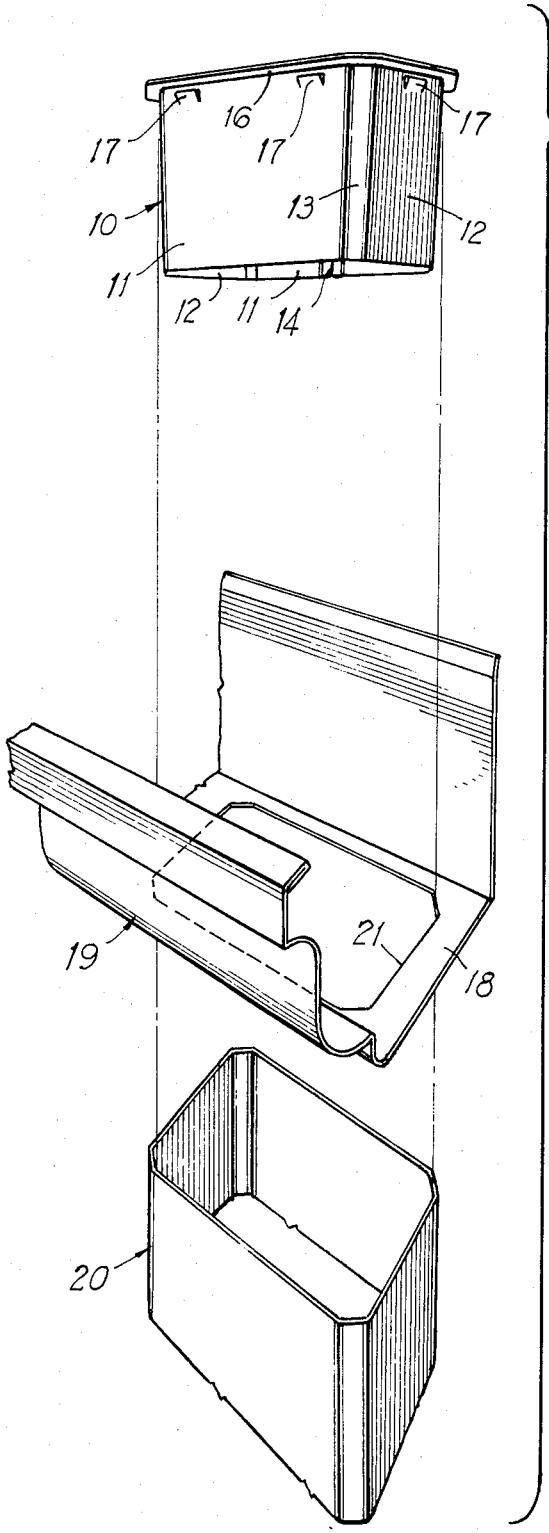
FIG. 1 is an exploded perspective view showing a gutter outlet tube according to the invention in association with a rain gutter and downspout.
Figure 2:
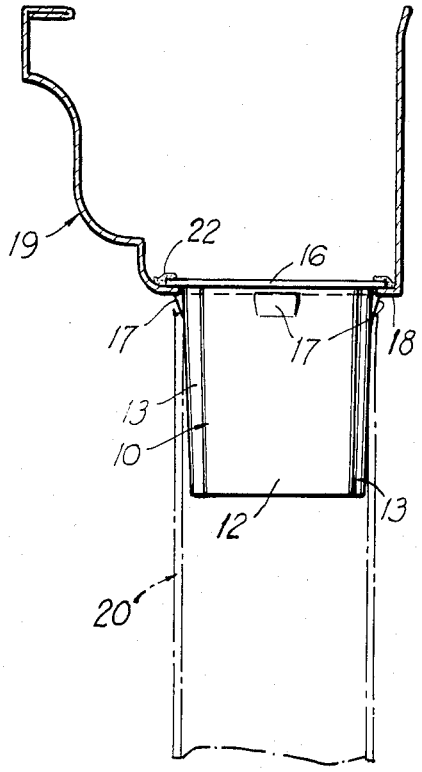
FIG. 2 is a vertical section taken through the assembled gutter outlet tube and downspout, partly in elevation and partly in phantom lines.
Figure 3:
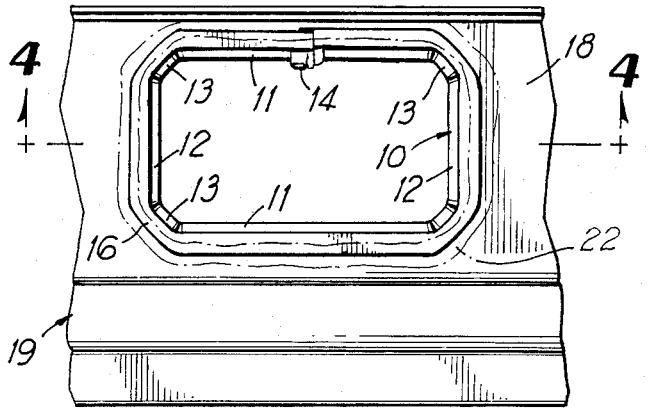
FIG. 3 is a fragmentary plan view of the assembly in FIG. 2.
Figure 4:
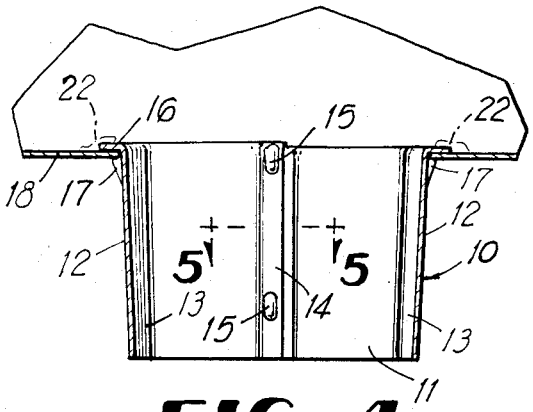
FIG. 4 is a vertical section taken on line 4—4 of FIG. 3.

The gutter bottom wall 18 has an opening 21 shaped to receive the outlet tube 10 with the latter projecting downwardly into the top of the downspout 20, as shown in FIG. 2. To connect the elements, it is merely necessary to insert the tapered outlet tube 10 downwardly through the opening 21 until the lock lugs 17 pass below the gutter bottom wall 18 and lockingly engage the lower face of the bottom wall 18. Two of the lock lugs 17 are provided on each major side wall 11 and one lock lug 17 is provided on each minor side wall 12 to provide a very secure connection of the outlet tube with the gutter. The outlet tube 10 being tapered snugly and wedgingly engages in the downspout 20 with the bottoms of the lugs 17 positioned at the top of the downspout, FIG. 2.

The support flange 16 is sealed to the gutter bottom wall 18 with a conventional sealant 22.

Referring to the blank B, FIG. 6, the two major side walls 11 of the tapered outlet tube 10 are formed by a central panel 23 of the blank and two opposite end half-panels 24. The minor side walls 12 are formed by a pair of intermediate relatively narrow panels 25 of the blank.

Figure 5:
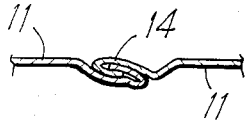
FIG. 5 is an enlarged fragmentary horizontal section taken on line 5—5 of FIG. 4.

The support flange 16 of the outlet tube is formed by the folding of a longitudinal strip 26 of the blank on a longitudinal folding line 27 near one edge of the blank. The panels 23, 24 and 25, as well as the strip 26, are foldable on folding lines 28 of the blank B, as shown in FIG. 6. The lock lugs 17 may be struck in the blank prior to its folding. The edge portions 29 of the two end panels 24 are formed and crimped to produce the lock seam 14 shown in FIG. 5.

The completed outlet tube 10 is of one piece or unit construction with all elements thereof integrally formed rather than being separate attachments as in the prior art. This renders the outlet tube very easy to handle and install, as well as inexpensive to manufacture. The proximity of the lock lugs 17 to the support flange 16 assures a stable and wobble-free joint with the gutter bottom wall 18.

The outlet tube according to the invention can be manufactured in a number of different sizes, such as 2"×3", 3"×4", and 4"×5", so as to be compatible with standard sizes of downspouts. If desired, in lieu of the sealant 22, the flat flange 16 can be easily soldered to the flat bottom wall 18.

The advantages of the invention over the prior art should be readily apparent in light of the foregoing description.

It is to be understood that the form of the invention herewith shown and described is to be taken as a preferred example of the same, and that various changes in the shape, size and arrangement of parts may be resorted to, without departing from the spirit of the invention or scope of the subjoined claims.

We claim:

1. In a connection for a gutter and downspout, the gutter having a flat bottom wall provided with a generally rectangular opening in alignment with the top of the downspout, a gutter outlet tube comprising a generally flat, arcuate blank member foldable into a generally octagonal, inwardly tapering tube body having four side walls and corner web portions for connecting said side walls for projecting downwardly through the rectangular opening and into the downspout, an integral, continuously formed, top marginal support flange on said tube body for sealing engagement with the gutter bottom wall, and integrally formed outstruck downwardly tapering lock lugs on said four side walls at a common elevation closely below said flange and spaced therefrom a distance approximating the thickness of the gutter bottom wall.

2. In a connection for a gutter and downspout, a gutter outlet tube as defined in claim 1 in which said four side walls include two relatively wide side walls each having two of said lugs formed therein and two relatively narrow end walls each having one of said lugs formed therein.

3. A one-piece gutter outlet tube for joining a gutter bottom wall having an opening to accept the gutter outlet tube with a downspout beneath the gutter bottom wall, the gutter outlet tube comprising a tube body formed by the folding of an initially flat arcuate one-piece blank for insertion through a gutter bottom wall opening and into the top end portion of a downspout, a continuous outwardly projecting marginal flange carried by the top end of said tube body and adapted to rest on a gutter bottom wall, a lock seam extending from top-to-bottom on a side wall of the outlet tube including said marginal flange, and a plurality of spaced downwardly tapered outwardly struck lock lugs integrally formed on said tube body at a common elevation around the margin of the tube body and having top edges which are spaced below said flange by a distance approximating the thickness of a gutter bottom wall with which the outlet tube is lockingly assembled, the top edges of said lock lugs being adapted to lockingly engage beneath a gutter bottom wall around the margin of the opening in such wall through which the gutter outlet tube is inserted downwardly.

4. A one-piece gutter outlet tube as defined in claim 1 wherein the tube body is approximately rectangular in cross section and downwardly tapering.

5. A gutter outlet tube as defined in claim 4, and said tube body having two major and two minor side walls, and a pair of said lock lugs being disposed in spaced relationship on each major side wall and one lock lug being disposed centrally on each minor side wall.

* * * * *